US012741225B2

(12) United States Patent
Rupp et al.

(10) Patent No.: US 12,741,225 B2
(45) Date of Patent: Sep. 22, 2026

(54) FLYING THEATER MOTION BASE AND RELATED METHODS

(71) Applicant: Dynamic Structures LTD, Port Coquitlam (CA)

(72) Inventors: David Robert Rupp, Frederick, MD (US); Michael Gedig, Vancouver (CA); Ryszard Job, Vancouver (CA)

(73) Assignee: DYNAMIC STRUCTURES LTD., Port Coquitlam (CA)

( * ) Notice: Subject to any disclaimer, the term of this patent is extended or adjusted under 35 U.S.C. 154(b) by 940 days.

(21) Appl. No.: 17/936,193

(22) Filed: Sep. 28, 2022

(65) Prior Publication Data

US 2023/0098299 A1 Mar. 30, 2023

Related U.S. Application Data

(60) Provisional application No. 63/249,637, filed on Sep. 29, 2021.

(51) Int. Cl.
*A63G 31/16* (2006.01)
*A63J 5/00* (2006.01)

(52) U.S. Cl.
CPC ..... *A63G 31/16* (2013.01); *A63J 2005/002* (2013.01)

(58) Field of Classification Search
CPC .. A63J 2005/001; A63J 2005/002; A63J 5/00; A63G 31/16; A63G 27/00; A63G 1/24
See application file for complete search history.

(56) References Cited

U.S. PATENT DOCUMENTS

| | | | | |
|---|---|---|---|---|
| 4,879,849 | A * | 11/1989 | Job | A63G 31/16 |
| 6,354,954 | B1 | 3/2002 | Sumner | |
| 9,463,391 | B2 | 10/2016 | Job et al. | |
| 9,833,718 | B2 * | 12/2017 | De-Gol | A63J 25/00 |
| 10,857,472 | B1 * | 12/2020 | Gil | G06F 3/011 |
| 11,040,291 | B2 * | 6/2021 | Kaufmann | A63J 25/00 |
| 2002/0183123 | A1 | 12/2002 | De-Gol | |
| 2015/0018107 | A1 | 1/2015 | Kaastra | |
| 2020/0324214 | A1 | 10/2020 | Jennings | |

FOREIGN PATENT DOCUMENTS

WO WO-2007057171 A2 * 5/2007 ..... A63J 25/00

OTHER PUBLICATIONS

Canadian Intellectual Property Office; International Search Report and Written Opinion for PCT/IB2022/000726; May 1, 2023; entire document.

* cited by examiner

*Primary Examiner* — Magdalena Topolski
(74) *Attorney, Agent, or Firm* — ALLEN, DYER, DOPPELT + GILCHRIST, P.A.

(57) ABSTRACT

A flying theater motion base is implemented using one or more rows of seats pivotably connected to an end of a pivot structure about respective pitch axes, which is in turn pivotably supported over an underlying surface by a support structure about a pivot axis. One or more pivot drives are operable to pivot the pivot structure about the pivot axis to both move the rows of seats between a load/unload position adjacent the underlying surface and a show position elevated in front of a viewing area, and, while in the show position, simulate a heave motion by further pivoting the pivot structure about the pivot axis. One or more pitch drives adjust the pitch of the rows or seats about the pitch axes. The rows include canopies pivotably connected thereabove.

15 Claims, 9 Drawing Sheets

MIN HEAVE POSITION 23.3° PIVOT OUT OF LOAD

LOAD/ UNLOAD ORIENTATION

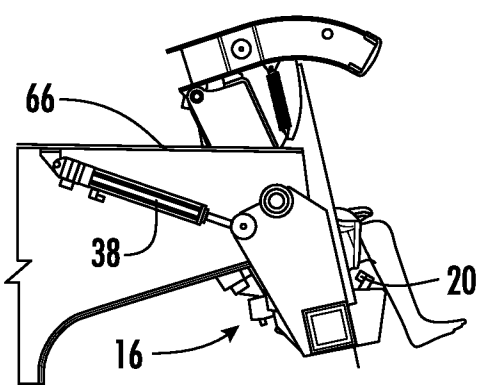
MAX HEAVE POSITION
FIG. 5D
MAX HEAVE, PITCH BACK
FIG. 5E
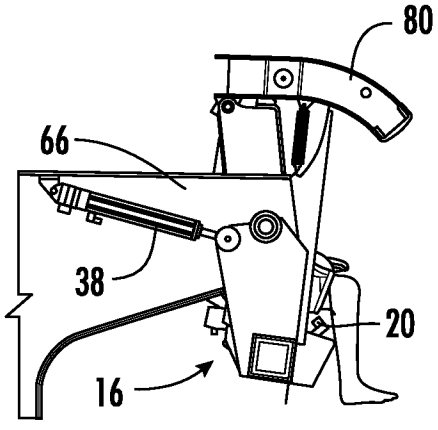
MAX HEAVE PITCH FORWARD
FIG. 5F 17.3° PIVOT OUT OF LOAD 8.6° PIVOT OUT OF LOAD

FLYING THEATER MOTION BASE AND RELATED METHODS

CROSS-REFERENCE TO RELATED APPLICATION

This application claims the benefit of U.S. Provisional Patent Application Ser. No. 63/249,637, filed on Sep. 29, 2021, the contents of which are herein incorporated by reference in their entirety.

FIELD OF THE INVENTION

The present invention relates to amusement rides, and more particularly, to flying theater attractions in which rows of seats are suspended in front of a screen and operable to impart movement thereto during a show.

BACKGROUND OF THE INVENTION

U.S. Pat. No. 9,463,391, issued on Oct. 11, 2016 (the contents of which are herein incorporated by reference in their entirety), discloses a "flying theater" attraction in which multiple rows of seats are pivotably carried by a platform structure of a motion base, which is turn translatably and pivotably connected to a pivot structure. Viewers are loaded and unloaded from a raised loading platform with the platform structure oriented horizontally and the seats upright. For show viewing, the platform is oriented more vertically, with the rows of seats pivoting to keep viewers generally upright. During the show, the rows of seats are pivoted relative to the platform to impart pitch motion and the platform is translated relative to the pivot structure to impart heave (up and down) motion, affording two degrees of freedom. The pitch and heave motions are synchronized with the show to achieve a desired overall experience This configuration has proved very successful for providing an entertaining flying theater experience for large numbers of viewers. However, the required space and mechanical complexity limit the implementation of the flying theater to larger venues. It would be desirable to provide a flying theater that could be implemented on a smaller scale while still offering a substantially similar motion experience.

SUMMARY OF THE INVENTION

In view of the foregoing, it is an object of the present invention to provide a flying theater motion base and related methods that are adapted for utilization in smaller venues. According to an embodiment of the present invention, a flying theater motion base includes a support structure, a pivot structure, at least a first row of seats, at least a first pivot drive and at least a first pitch drive. The first row of seats is pivotably connected to the pivot structure about a first row pitch axis with a pitch of the first row of seats about the first row pitch axis being adjustable by the first pitch drive. The pivot structure is pivotably connected to the support structure about a pivot axis and pivotable relative thereto by the first pivot drive. The support structure supports the pivot structure and first row of seats over an underlying surface in front of a viewing area.

The first pivot drive is operable to pivot the pivot structure to move the first row of seats between a load/unload position adjacent the underlying surface and a show position elevated above the underlying surface in front of the viewing area. While in the show position, the first pivot drive is further operable to pivot the pivot structure to move the first row of seats up and down to effectively simulate a heave motion. The first pitch drive is operable to maintain the first row of seats in a neutral pitch during movement between the load/unload position and the show position and to pitch the first row of seats forward and backward while in the show position.

According to an aspect of the present invention, the first row of seats includes a first canopy pivotably connected thereto such that a forward edge of the canopy is pivotable upwardly to facilitate loading and unloading of viewers. The upward pivoting is advantageously passively actuated by engagement between at least a first roller on the first canopy and at least a first cam surface of the pivot structure. Alternately, the pivoting of the first canopy can be actively actuated and operated synchronously with show events.

These and other objects, aspects and advantages of the present invention will be better appreciated in view of the drawings and following detailed description of preferred embodiments.

BRIEF DESCRIPTION OF THE DRAWINGS

FIGS. 5A-5F are side views of a representative row of seats of the motion base of FIG. 1 transitioning from the load/unload position to various states in the show position;

DETAILED DESCRIPTION OF PREFERRED EMBODIMENTS

Figure 1:
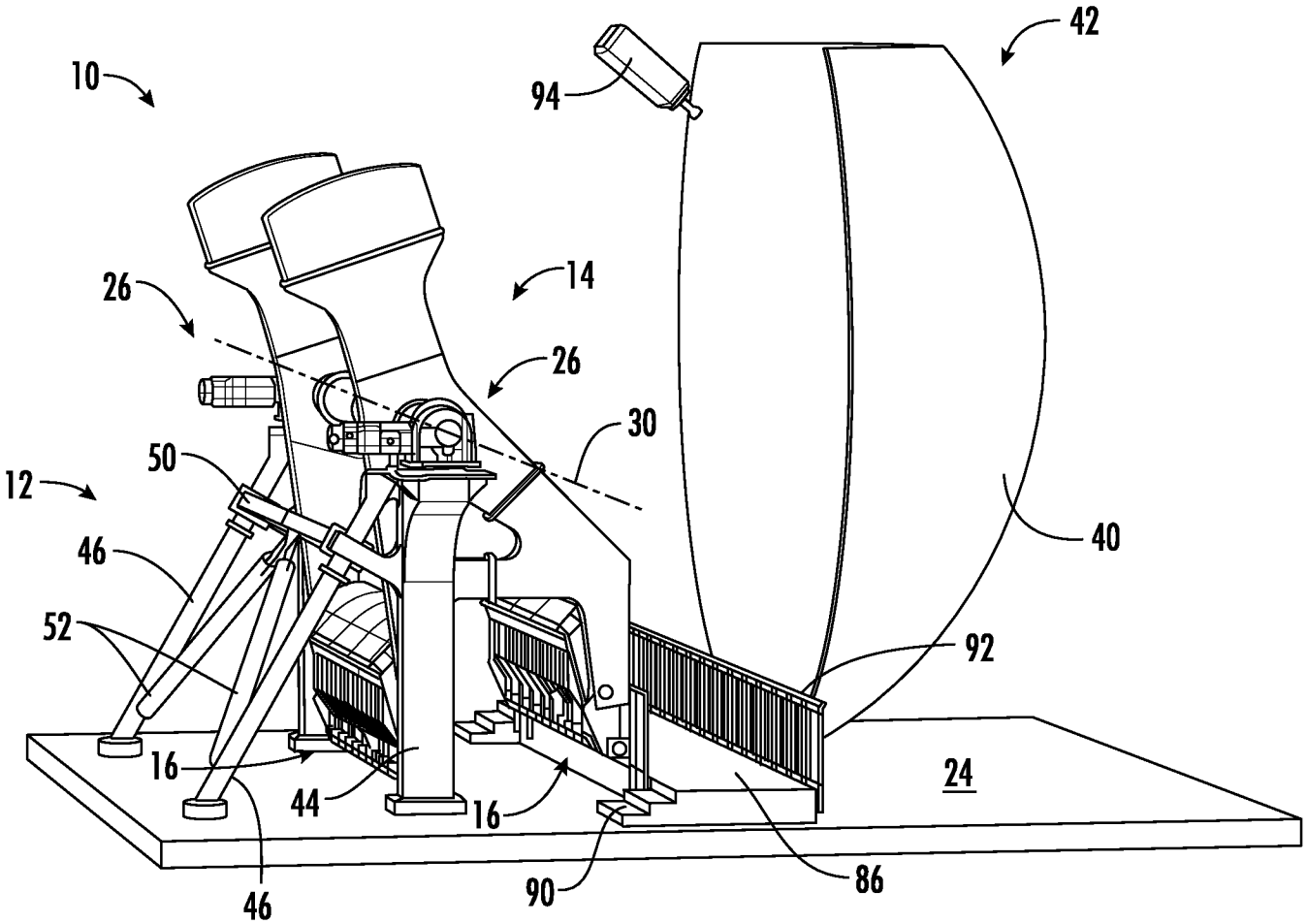
FIG. 1 is an overall isometric view of a theater including a flying theater motion base, according to an embodiment of the present invention, with rows of seats thereof in a load/unload position.
Figure 2:
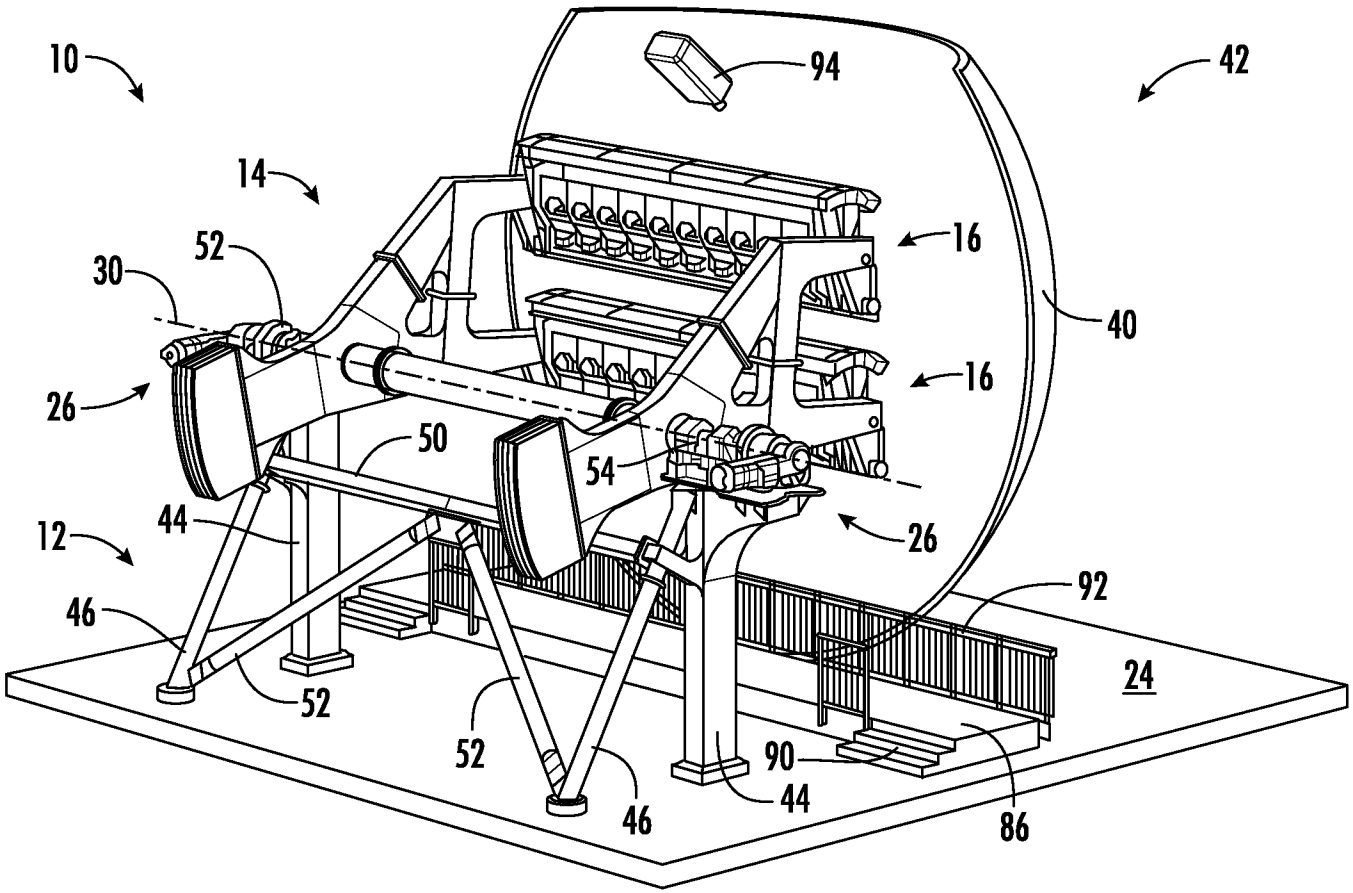
FIG. 2 is an overall isometric view of the theater of FIG. 1, with the rows of seats in a show position.
Figure 3:
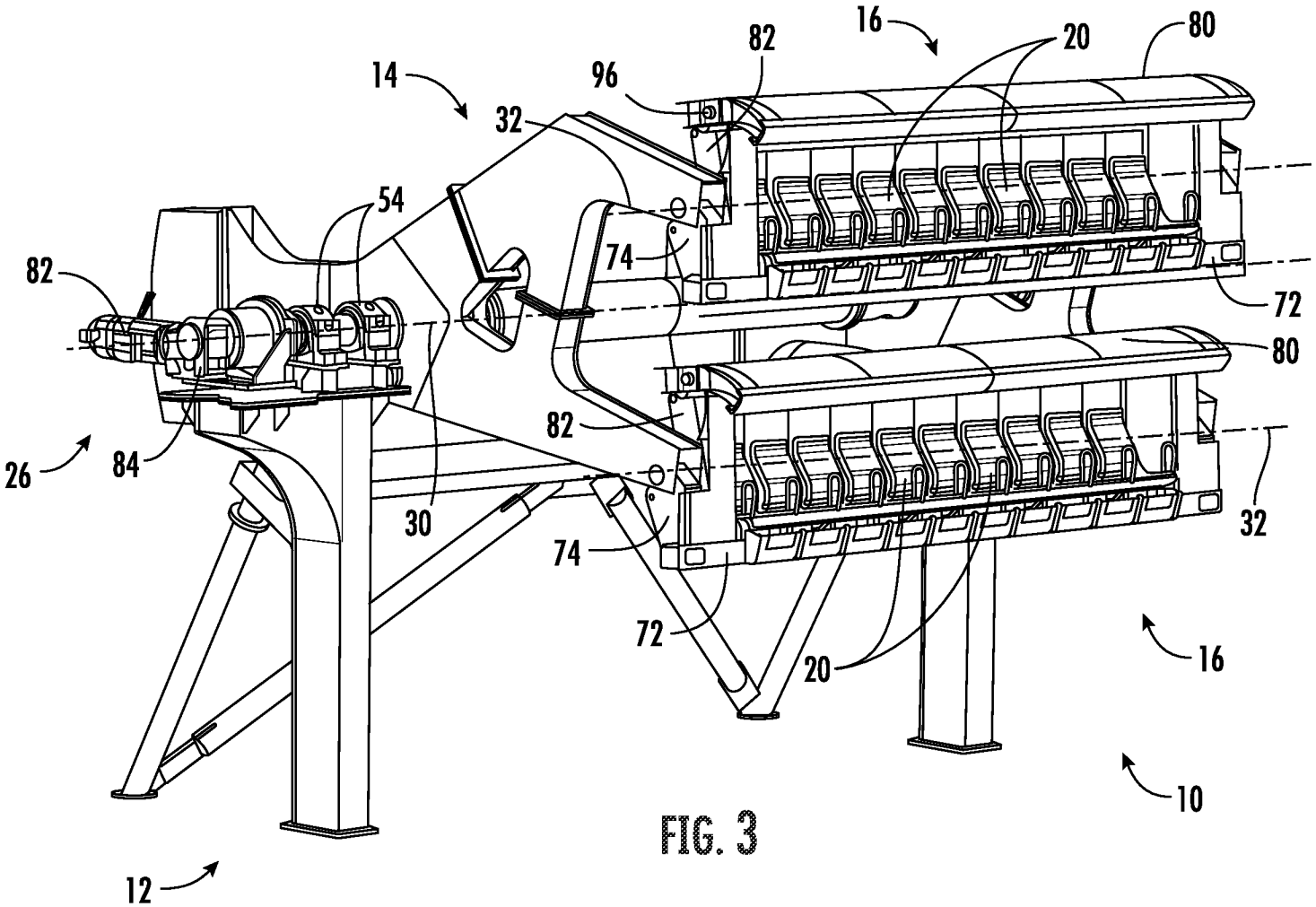
FIG. 3 is a front isometric view of the motion base of FIG. 1, with the rows of seats in the show position.

According to an embodiment of the present invention, referring to FIGS. 1-3, a flying theater motion base 10 includes a support structure 12, a pivot structure 14 and one or more rows 16 of seats 20. The pivot structure 14 is pivotably mounted to the support structure 12 for movement above an underlying surface, such as a venue floor 24, imparted by one or more pivot drives 26 about a pivot axis 30. The rows 16 of seats 20 are pivotably mounted the pivot structure 14 for movement about respective row pitch axes 32 imparted by pitch drives 38 (see FIG. 5A). Collectively, the motion base 10, underlying surface 24 and viewing area, such as projection screen 40, constitute a theater 42.

The pivot drives 26 are operable to pivot the pivot structure 14 to move the rows 16 of seats 20 between a load/unload position adjacent the floor 24 (as in FIG. 1) and a show position elevated above the floor in front of the screen 40 (as in FIG. 2). While in the show position, the pivot drives 26 are further operable to pivot the pivot structure 14 to move the rows 16 of seats 20 up and down to effectively simulate a heave motion. The pitch drives 38 are advantageously operable to maintain each row 16 of seats 20 in a neutral pitch during movement between the load/unload position and the show position and to pitch each row 16 of seats 20 forward and backward while in the show position. The generation of heave and pitch motion will be explained in greater detail below.

In the depicted embodiment, the support structure 12 includes columns 44 arranged on opposite ends of the pivot structure 14 and rear braces 46 extending between the floor 24 and upper ends of the columns 44. A lateral beam 50 extends between rear sides of the columns 44 with cross braces 52 extending from the center of the lateral beam 50 to the feet of each rear brace 46. The upper ends of the columns 44 carry bearings 54 for the pivot structure 14 as well as the pivot drives 26. In addition to providing lateral stiffness, the lateral beam delimits 50 the pivotal motion of the pivot structure 14. While the depicted support structure 12 is advantageous, it will be appreciated that differently configured support structures could be used in connection with the present invention. For instance, the support structure could incorporate structural elements (e.g., walls) of a given theater venue.

Figure 4:
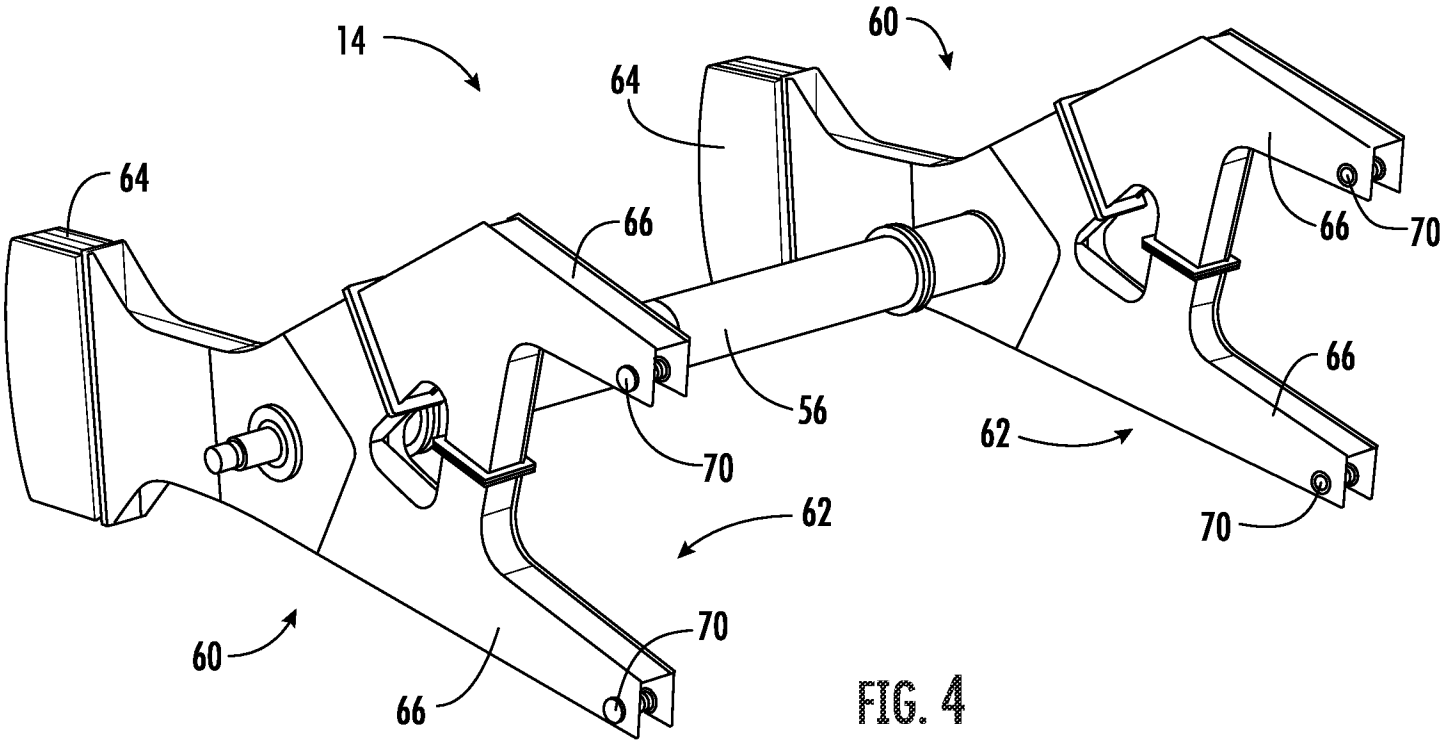
FIG. 4 is an isometric view of a pivot structure of the motion base of FIG. 1.

Referring to FIG. 4, the pivot structure 14 includes a pivot shaft 56 and opposite side supports 60. Opposite ends of the pivot shaft 56 are supported by the bearings 54 of the support structure 12 and engaged by the pivot drives 26. On one side of the shaft 56, an end of each side support 60 forms a fork 62 while a counterweight 64 is attached to the other end of each side support 60 on the opposite end of the shaft 56.

Each tine 66 of each fork 62 is hollow and accommodates a respective one of the pitch drives 38 as well as the support pins 70 for the rows 16 of seats 20. This configuration also helps hide the pitch drives 39 from the sight of viewers, helping create an element of surprise for the show.

The counterweights 64 can be monolithic blocks of steel, concrete or the like, or formed from multiple plates or other discrete elements. The weight of the counterweights is preferably set to counterbalance the collective weight of the opposite ends of the side supports 60, the rows 16 of seats 20 and an estimated weight of viewers to be seated therein.

Figure 5C:
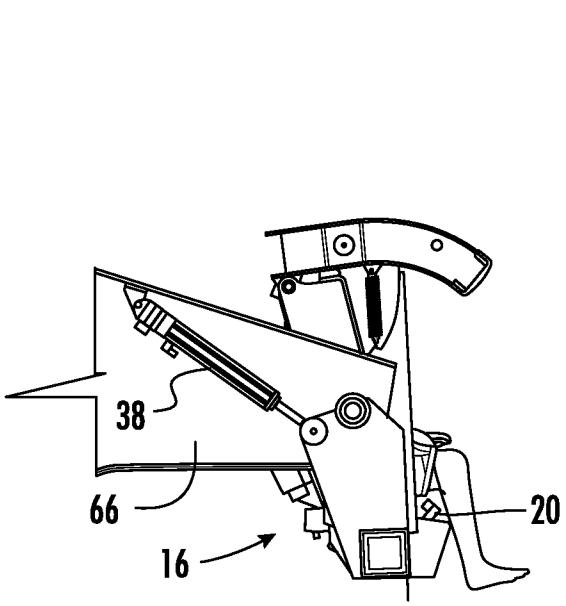
Figure 5B:
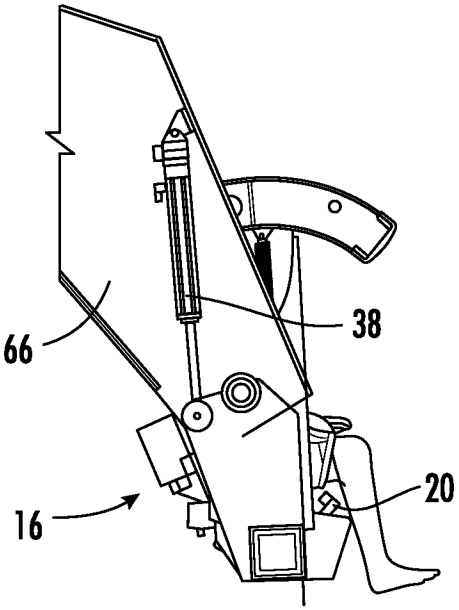
Figure 5A:
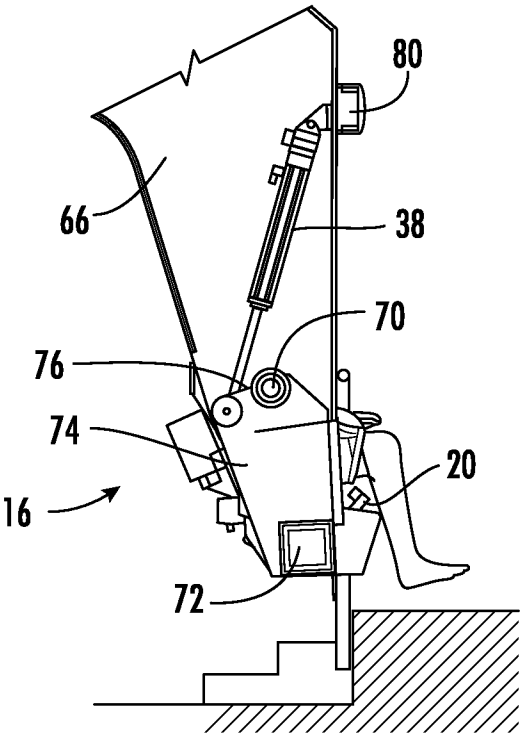

Referring again to FIG. 3, as well as to FIG. 5A, each row 16 of seats 20 includes a support beam 72 which carries the seats 20 and has a pitch structure 74 at each end. A boss 76 in each pitch structure 74 receives a respective one of the support pins 70 within the corresponding tine 66 of the pivot structure 14. Each pitch structure 74 also serves as an attachment point for the respective pitch drive 38. The rows 16 each also include a canopy 80 held over the seats 20, which prevents viewers in each row 16 from seeing viewers in the other row 16, protects viewers in the lower row 16 from objects dropped form the upper row 16, as well as restricting sightlines above the top of the screen 40 or other viewing area.

Each canopy 80 is pivotably connected to a pair of canopy supports 82 located inwardly of the seat pitch structures 74 so as to be adjacent an inner face of the respective tine 66. Each canopy 80 can also serve a discharge point for special effects such as wind, scent mist, special effect lighting and the like. The operation of the canopies 80 will be described in greater detail below.

Each pivot drive 26 preferably includes an electric motor 82 that engages a respective end of the pivot shaft 56 via a gearbox 84. Each pivot drive 26 preferably also includes a brake. Although the depicted embodiment includes a pair of pivot drives 26, it will be appreciated that a single pivot drive 26 could be used; for instance, a centrally located drive could connect between split pivot shafts extending laterally to the side supports.

The pivot drives 26 are computer controlled and operated to pivot the pivot structure 14 to move the rows 16 of seats 20 between the load/unload position (FIG. 1) and the show position (FIG. 2). The pivot structure 14 is generally vertical in the load/unload position and generally horizontal in the show position. Because the pivot structure 14 holds the rows 16 of seats 20 at a substantial distance from the pivot axis 30, limited pivotal motion of the pivot structure 14 while in the show position will be perceived by viewers as an up/down heave motion. FIGS. 5C and 5D illustrate neutral seat 20 pitch orientations at minimum and maximum heave points, respectively, within the show position. Heave motions are advantageously synchronized to correspond with events taking place on the projection screen 40 or other actions within the viewing area.

Referring again to FIGS. 1 and 2, to facilitate loading and unloading of viewers from an uppermost row 16 of seats 20, the venue floor 24 can be provided with an elevated portion 86 accessible via steps 90, ramps or the like. Railings 92 can be provided around the elevated portion 86 for viewer safety.

Each pitch drive 38 is preferably a linear actuator, such as a motor-driven lead screw-type actuator, which acts between a respective one of the pitch structures 74 of the corresponding row 16 of seats 20 and a mounting point within the tine 66. Thus, by extending and retracting, the drives 38 actively vary the pitch of each row 16 of seats 20 about its pitch axis 30. The pitch drives 38 are also computer controlled and advantageously operated to maintain a neutral seat pitch in the load/unload position and while transitioning to and from the show position, despite the changing orientation of the pivot structure 14 (as shown in the transition from FIGS. 5A to 5C). While in the show position, and again advantageously synchronized to correspond with show events, the pivot drives 38 are operated to pitch the rows 16 of seats 20 backwards and forwards (shown in FIGS. 5E and 5F, respectively). Pitch motions can be imparted in coordination with heave motions or independently therefrom, depending on the desired effect.

Although a projection screen 40 (coupled with a projector 94) represents a preferred embodiment, other electronic, mechanical and/or live display elements could be employed within the viewing area. Also, the projection screen 40 can be flat, curved (including various hybrid curves) or, as in the depicted embodiment, hemispherical. Advantageously, the use of a hemispherical screen in tandem with the seat canopies 80 effectively limits to the field of view of the viewers to the screen, offering a more immersive effect.

Figure 6B:
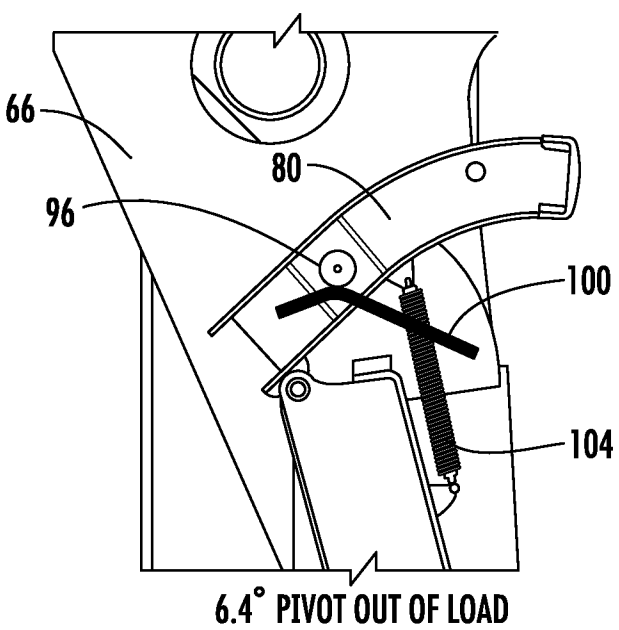
FIGS. 6A-D are side views of different stages of a representative interface between a seat canopy of a representative row of seats and a portion of the pivot structure of the motion base of FIG. 1.
Figure 6A:
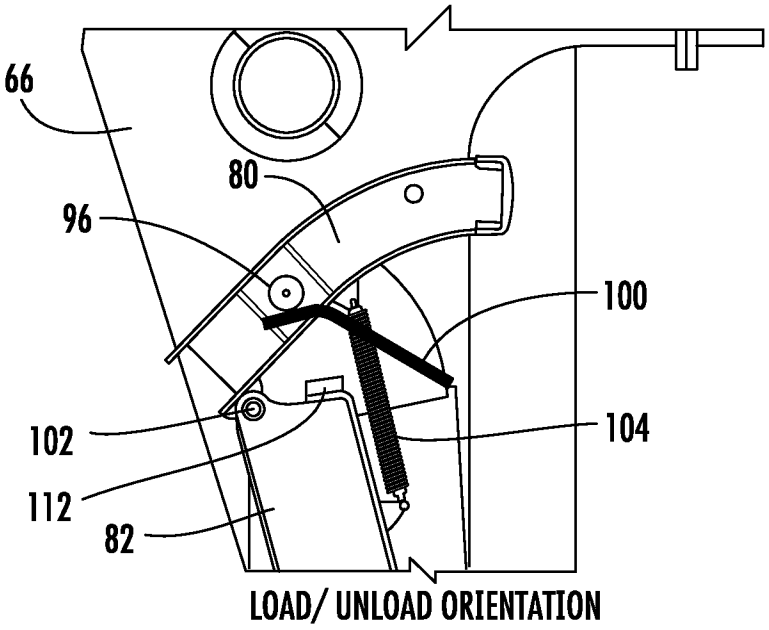

The use of pivotably mounted canopies 80 allows positioning closer to the viewer, such that a shorter canopy can achieve the same visual delimitation as larger canopy positioned farther away. Advantageously, a passive actuation system is used to pivot the canopies 80 when transitioning to and from the load/unload position. Referring to FIG. 6A, rollers 96 extend laterally from opposite ends of each canopy 80, with each roller 96 engaging a wedge cam surface 100 formed on the respective inner surfaces of the corresponding tines 66. The rear edges of each canopy 80 have pivot connections 102 with the upper ends of the respective canopy supports 82. Each end of each canopy 80 also includes a return spring 102 urging the forward end of the canopy 80 downwardly.

Figure 6D:
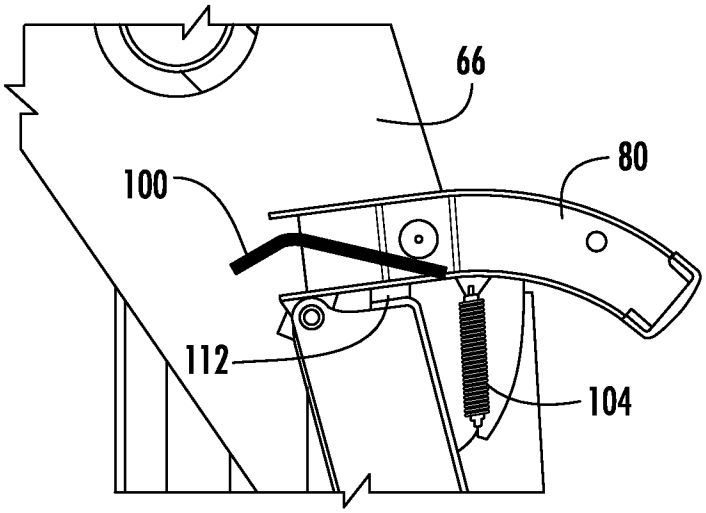
Figure 6C:
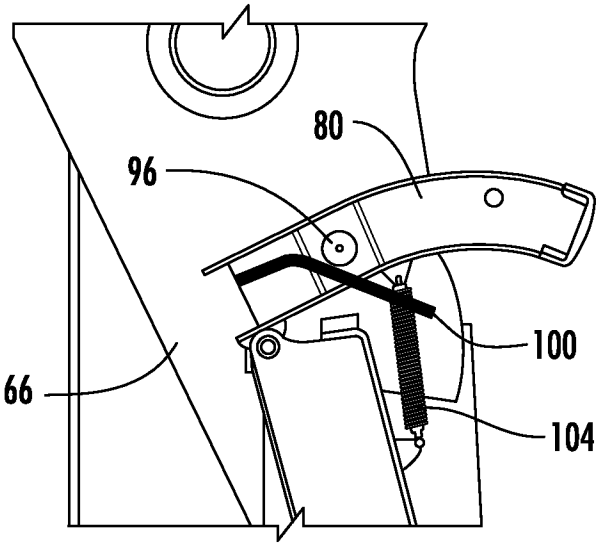

With the pivot structure 14 in the load/unload position (as in FIG. 6A), each roller 96 is on an upper section of the corresponding wedge cam surface 100, holding the corresponding canopy 80 in its upwardly pivoted position despite the force of the return springs 102. However, as the pivot structure 14 pivots out of the load/unload position, each roller 96 transitions to a lower section of the corresponding wedge cam surface 100, allowing the return springs 102 to gradually pivot the canopy 80 front edges downwardly (FIGS. 6B and 6C) until hard stops 112 on the upper ends of the canopy supports 82 are engaged (FIG. 6D). In the show position, the rollers 96 are completely disengaged from the cam surfaces 100 and the canopies 80 remain down under the impetus of the springs 102 (see. e.g., FIGS. 5C-5F). The canopies 80 automatically open as the pivot structure 14 pivots back into the load/unload position when the rollers 96 reengage the cam surfaces 100 in the reverse of the foregoing.

In an alternate embodiment, the return springs 104 can be replaced with linear actuators, allowing for active pivoting of the canopies 80. Active control of the canopies allows for a controlled delimitation of the field of view while the rows 16 of seats 20 are moved in the show position. For instance, the canopies 80 can be pivoted upwardly to permit a larger field of view when the rows 16 of seats 20 are pitched forward and vice versa.

Figure 7:
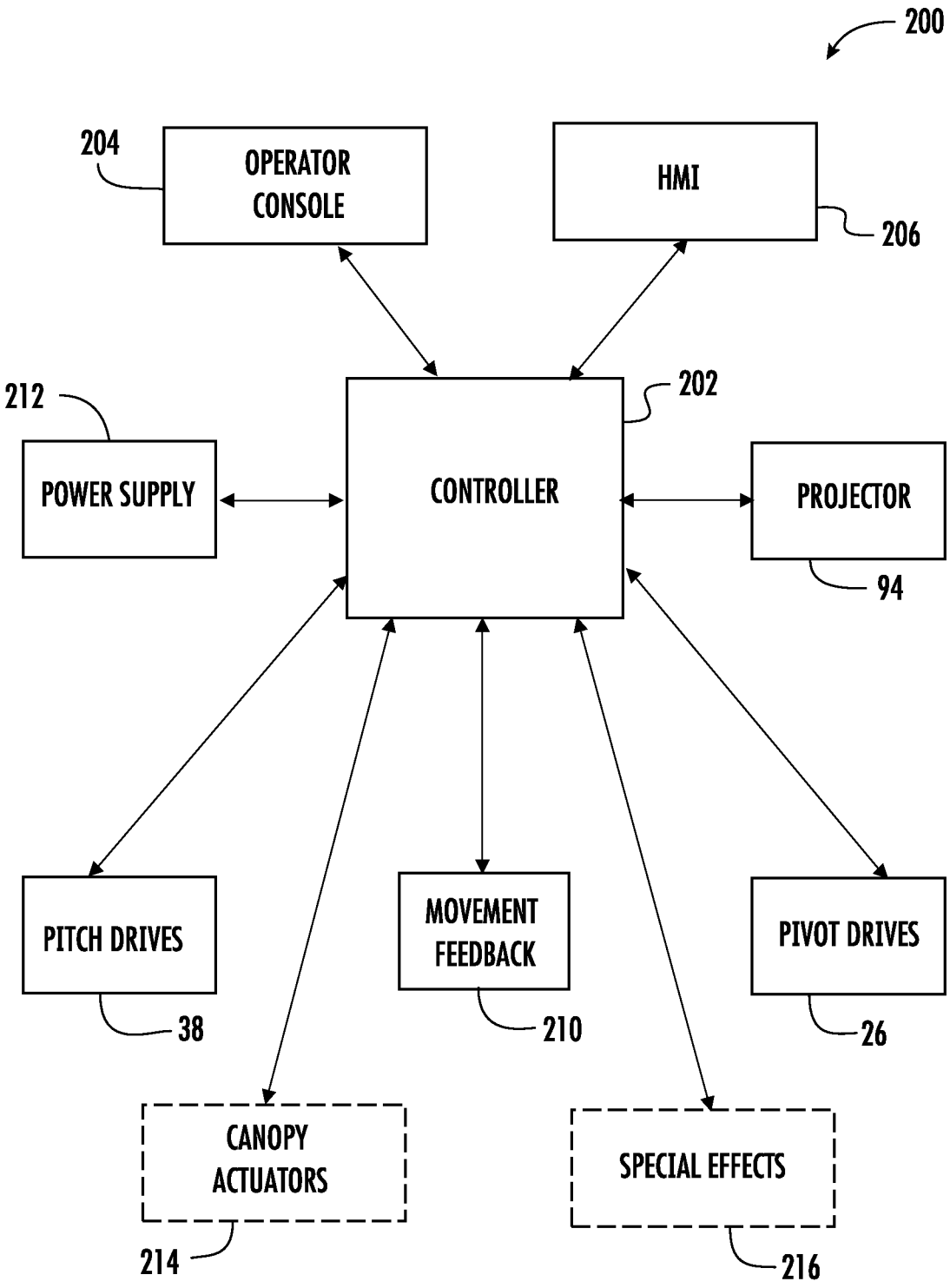
FIG. 7 is a schematic overview of a ride control system operating the motion base of FIG. 1.

Referring to FIG. 7, operation of the motion base 10 is advantageously controlled through use of a ride control system 200. The ride control system may comprise a ride control sub-system controller 202, operator control consoles 204, Human machine interfaces (HMI) 206, feedback devices 210 mounted on the pivot structure 14 and the support structure 12, motion controllers, and hardwired emergency stop circuits. The ride control system 200 is preferably configured to move the motion base in a smooth and flowing motion when moving the pivot structure 14 from the load/unload position to the show position.

A ride control subsystem controller commonly known to persons skilled in the art may be used for control of the motion base. The ride control system may use network protocols commonly known to persons skilled in the art to communicate with controllers on the motion base to receive, transmit, or communicate status and diagnostic information. In one embodiment, the ride control system may include an uninterruptible power supply (UPS) 212 that will support the controls to return the pivot structure 14 to the load/unload position with the seats 20 at neutral pitch in the event of a loss of power to the theater.

According to a method aspect, at the start of a show (such as a movie or other presentation) the pivot structure 14 is positioned with the rows 16 of seats 20 in the load/unload position, and, as such, the viewers entering the theater can only see the rows 16 of seats 20. The screen is purposely kept dark. As part of the show sequence, the pivot drives 26 rotate the pivot structure 14 to move the rows 16 of seats 20 from the load/unload position into the show position while pitch drives 38 maintain a neutral pitch, thereby lifting the seats 20 up from the ground and giving a breathtaking "reveal moment" as the projected image comes alive on the screen. The element of surprise for the "reveal moment" can be further enhanced with the application of fog or mist effect while the pivot structure 14 is rotating the seats 20 into the show position. If controlled by active actuators 214, the control system will also control the movement thereof.

Once in the show position, the pivot structure 14 in combination with the pitch drives 38 will move in synchronization with the projected images on the screen. Special effects 216 such as wind, mist, scent and special effects lighting will be discharged from the canopies 80 or elsewhere at preprogrammed points of the show to enhance the immersive effect. At the end of the show, the rows 16 of seats 20 are smoothly returned to the load/unload position by the pivot drives 26 rotating the pivot structure 14 in combination with the pitch drives 38 adjusting the pitch of the rows 16 of seats 20.

It will be appreciated that a motion base for a flying theater according to the present invention allows for a simplification of the motion base used in the prior art flying theater by eliminating the need for a separate translation mechanism while still effectively allowing viewers to experience the same two degrees of freedom during a show. Additionally, the need for an elevated loading platform is eliminated, as viewers can take their seats from the venue floor or only a few steps up—again allowing accommodating of the motion base within a smaller space. The pivoting canopy design also allows shorter canopies to be used to achieve a desired degree of sightline restriction relative to a fixed canopy high enough to allow easy viewer entrance and egress.

The embodiments of the invention described above are intended to be exemplary only. Those skilled in this art will understand that various modifications of detail may be made to these embodiments, all of which come within the scope of the invention and of the claims appended hereto.

What is claimed is:

1. A flying theater motion base comprising:

a support structure configured for mounting over an underlying surface in front of a viewing area;

a pivot structure pivotably connected to the support structure about a pivot axis;

a first row of seats pivotably connected to the pivot structure about a first row pitch axis;

a first pivot drive operable to pivot the pivot structure about the pivot axis over the underlying surface; and a first pitch drive operable to adjust a pitch of the first row of seats about the first row pitch axis;

wherein the first pivot drive is operable to pivot the pivot structure to move the first row of seats between a load/unload position adjacent the underlying surface and a show position elevated above the underlying surface in front of the viewing area;

wherein, while in the show position, the first pivot drive is further operable to pivot the pivot structure to move the first row of seats up and down to simulate heave motions;

wherein the first pitch drive is operable to maintain the first row of seats in a neutral pitch in the load/unload position and to pitch the first row of seats forward and backward while in the show position;

wherein the pivot structure includes a pivot shaft supported by the support structure and engaged by the first pivot drive, and a pair of outside side supports connected to the pivot shaft, each of the outside side supports having a first end tine, the first row of seats being pivotably connected between the first end tines of the outside side supports; and wherein at least one of the first end tines has a hollow interior and the first pitch drive is connected between the first row of seats and one of the outside side supports within the hollow interior.

2. The flying theater motion base of claim 1, further comprising:

a second row of seats pivotably connected to the pivot structure about a second row pitch axis; and a second pitch drive operable to adjust a pitch of the second row of seats about the first row pitch axis;

wherein the first pivot drive is operable to pivot the pivot structure to move the first and second rows of seats between the load/unload position adjacent the underlying surface and the show position elevated above the underlying surface in front of the viewing area;

wherein, while in the show position, the first pivot drive is further operable to pivot the pivot structure to move the first and second rows of seats up and down to simulate a heave motion; and wherein the second pitch drive is operable to maintain the second row of seats in a neutral pitch in the load/unload position and the show position and to pitch the second row of seats forward and backward while in the show position.

3. The flying theater motion base of claim 1, wherein each of the outside side supports carries a counterweight at a second end thereof.

4. The flying theater motion base of claim 1, wherein the first row of seats includes a support beam carrying a plurality of seats of the first row of seats and a pitch structure extending upwardly from an end of the support beam into the hollow interior of the at least one of the first end tines, the first pitch drive being connected to the pitch structure.

5. The flying theater motion base of claim 4, wherein a support pin pivotably connects the pitch structure with the at least one of the first end tines.

6. The flying theater motion base of claim 1, wherein the first row of seats includes a first canopy extending over a plurality of seats thereof and at least one first canopy support pivotably connected to the canopy.

7. The flying theater motion base of claim 6, wherein a front edge of the first canopy is configured to pivot downwardly as the pivot structure pivots to move the first row of seats from the load/unload position to the show position and to pivot upwardly as the pivot structure pivots to move the first row of seats from the show position to the load/unload position.

8. The flying theater motion base of claim 7, wherein a roller on the first canopy engages a wedge cam surface on the pivot structure to effect the pivoting of the front edge of the first canopy during movement between the load/unload and show positions.

9. The flying theater motion base of claim 8, wherein a spring acting between pivot support and the canopy urges the front edge of the canopy to pivot downwardly and the engagement between the wedge cam surface and the roller overcomes the a force of the spring when the pivot structure moves the first row of seats from the show position to the load/unload position.

10. The flying theater motion base of claim 7, wherein at actuator extends between the first canopy and the pivot structure to effect the pivoting of the front edge of the first canopy during movement between the load/unload and show positions.

11. The flying theater motion base of claim 10, wherein the actuator is a linear actuator.

12. The flying theater motion base of claim 1, wherein the support structure includes columns extending from the underlying surface and supporting opposite ends of the pivot structure.

13. The flying theater motion base of claim 12, wherein the support structure further includes rear braces extending from the underlying surface to upper ends of the columns.

14. The flying theater motion base of claim 13, wherein the support structure further includes a lateral beam extending between the columns.

15. The flying theater motion base of claim 14, wherein the support structure further includes cross braces extending from a center of the lateral beam to feet of the rear braces.

* * * * *